US006450680B1

(12) United States Patent
Bertolotti et al.

(10) Patent No.: US 6,450,680 B1
(45) Date of Patent: Sep. 17, 2002

(54) APPARATUS FOR MIXING POWDER

(75) Inventors: Gérard Bertolotti, Montreuil; Bernard Defontaine, Maurepas; Christian Trevisan, Chatou, all of (FR)

(73) Assignee: Compagnie Generale Des Matieres Nucleaires, Velizy-Villacoublay (FR)

( * ) Notice: Subject to any disclaimer, the term of this patent is extended or adjusted under 35 U.S.C. 154(b) by 0 days.

(21) Appl. No.: 09/551,425

(22) Filed: Apr. 18, 2000

(30) Foreign Application Priority Data

Apr. 21, 1999 (FR) ..... 99 05020

(51) Int. Cl.[7] ..... B01F 7/10

(52) U.S. Cl. ..... 366/141; 366/114; 366/316; 366/317; 366/331; 366/286

(58) Field of Search ..... 366/114, 141, 366/189, 196, 315, 316, 317, 331, 285, 286

(56) References Cited

U.S. PATENT DOCUMENTS

| | | | | |
|---|---|---|---|---|
| 1,192,492 | A | * | 7/1916 | Blichfeldt |
| 2,559,516 | A | | 7/1951 | Russell |
| 2,637,330 | A | * | 5/1953 | Webster |
| 3,672,642 | A | | 6/1972 | Beisswenger |
| 3,726,509 | A | | 4/1973 | Lammers et al. |
| 4,021,024 | A | | 5/1977 | Stasi |
| 4,157,872 | A | * | 6/1979 | Davido, Sr. |
| 4,208,134 | A | | 6/1980 | Whittle |
| 4,212,547 | A | * | 7/1980 | Thomson |
| 4,660,990 | A | * | 4/1987 | Svensson |
| 4,895,450 | A | * | 1/1990 | Holik |
| 5,360,265 | A | * | 11/1994 | Cruse |
| 5,813,754 | A | * | 9/1998 | Williams |

FOREIGN PATENT DOCUMENTS

| | | |
|---|---|---|
| AU | 51 945 79 | 4/1981 |
| DE | 1 801 414 | 5/1970 |
| FR | 2 341 357 | 9/1977 |
| JP | 06007660 | 1/1994 |

* cited by examiner

*Primary Examiner*—Charles E. Cooley
*Assistant Examiner*—David Sorkin
(74) *Attorney, Agent, or Firm*—Wolf, Greenfield & Sacks, P.C.

(57) ABSTRACT

The powder mixing apparatus comprises a circular section cylindrical body having a longitudinal axis that is substantially horizontal, the body being leakproof and having two disk-shaped walls and an annular wall, the apparatus having a disk placed coaxially inside said body, the edge of said disk being substantially in contact with the annular wall so as to subdivide said body into two cylindrical compartments of substantially equal volume, said disk being provided on each of its faces with at least one blade for guiding said powder during rotation of said disk to a transfer orifice passing through said disk so as to enable at least a portion of the powder contained in one compartment to pass into the other compartment on each revolution of the disk, said blades being angularly offset, a horizontal drive shaft secured to the center of said disk serving to rotate said disk, and motor means serving to drive said drive shaft.

24 Claims, 10 Drawing Sheets

APPARATUS FOR MIXING POWDER

The present invention relates to apparatus for mixing powder.

BACKGROUND OF THE INVENTION

More specifically, but not exclusively, the present invention relates to apparatus for mixing powder that is specially adapted to processing radioactive powder, such as plutonium dioxide ($PuO_2$). Such powder mixing apparatus must not only comply with constraints concerning the uniformity, grain size, and isotopic composition of the powder while also ensuring that no segregation occurs, it must also comply with constraints concerning safety and criticality that are inherent to the fissile nature of the radioactive powder.

OBJECTS AND SUMMARY OF THE INVENTION

The powder mixing apparatuses that have been proposed in the past do not enable both of those conditions to be complied with effectively.

To achieve this object, the present invention provides powder mixing apparatus, comprising:

- a cylindrical body of circular section and of substantially horizontal longitudinal axis, which body is leakproof and has two disk-shaped walls and one annular wall, said body being provided with at least one filling orifice situated at the top of said body and with at least one emptying orifice opening out into the bottom of said body;
- a disk placed coaxially inside said body, the edge of said disk being substantially in contact with the annular wall so as to subdivide said body into two cylindrical compartments of substantially equal volume, said disk being provided on each of its faces with at least one blade that is substantially in contact at least with the disk-shaped wall adjacent to said blade, said blade serving to guide said powder during rotation of said disk to a radially inner end segment of said blade adjacent to a transfer orifice passing through said disk so as to enable at least a portion of the powder to pass from one compartment to the other on each revolution of the disk, said blades being angularly offset;
- a horizontal drive shaft secured to the center of said disk to rotate said disk; and
- motor means for rotating said drive shaft.

This solution using a bladed disk placed in a cylindrical body and provided with transfer orifices makes it possible to homogenize the powder contained in the cylindrical body in very effective manner by mixing.

When the present invention is used with radioactive powder, it is essential in order to comply with criticality constraints, to make provision for the width of the annular wall of the cylindrical body to be smaller than a value set by safety and criticality constraints. In this way, a "flat" type cylindrical body is obtained presenting a circular section that is relatively large relative to its axial or longitudinal dimension.

The mass of powder contained in the powder mixing apparatus must be known, both in order to obtain batches of similar mass and also to restrict said mass so as to obtain good mixing, which is a function of the total volume of the cylindrical body serving as the mixing reservoir.

Another object of the present invention is thus to enable the mass of the cylindrical body that serves as the powder reservoir to be measured continuously, in particular during the filling stage, so as to interrupt powder feed once the proper filling level has been reached.

This object is achieved by the fact that the powder mixing apparatus further comprises a rigid frame and a system, such as a load cell, for weighing the cylindrical body by suspension, the system comprising a deformable element connected to said frame and from which the cylindrical body is suspended. Under such circumstances, it will be understood that variation in the length of the deformable element represents variation in the weight of the cylindrical body, in particular while it is being filled with powder.

Another object of the present invention is to satisfy safety constraints associated with seismic risks so as to provide powder mixing apparatus that presents freedom of movement that is controlled and limited.

To achieve this object, provision is made for the powder mixing apparatus further to comprise an assembly mounted on said frame to guide the cylindrical body in vertical translation. This guide assembly allows the cylindrical body to move in vertical translation to a limited and controlled extent, while strictly limiting the movement of the cylindrical body in all other directions (horizontal movements and rotations).

BRIEF DESCRIPTION OF THE DRAWINGS

Other characteristics and advantages of the present invention will appear on reading the following description made with reference to the accompanying drawings, given purely by way of non-limiting example, and in which.

MORE DETAILED DESCRIPTION

Figure 1:
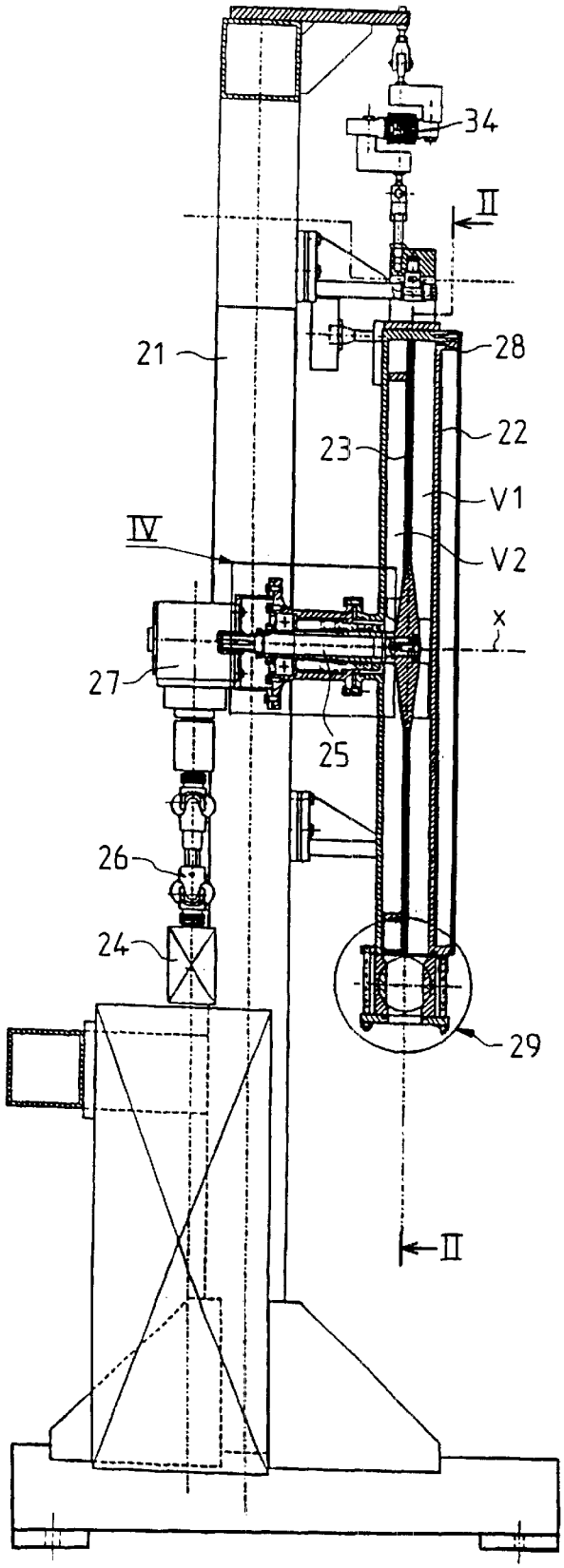
FIG. 1 is a longitudinal section view of a preferred embodiment of powder mixing apparatus of the present invention.

In the accompanying figures, overall reference 20 designates the powder mixing apparatus of the present invention, which apparatus essentially comprises a frame 21 and a cylindrical body 22 serving as a mixing reservoir for the powder to be mixed and/or homogenized.

The cylindrical space of the body 22 is subdivided into two cylindrical compartments V1 and V2 of substantially equal volume by means of a bladed disk 23 coaxial with the body 22 and of structure that is described in detail below.

The bladed disk 23 is rotated by means of a motor 24 fixed to the frame 21 and a transmission system between the motor 24 and a horizontal drive shaft 25 which is secured to the disk 23 so as to enable the bladed disk 23 to be rotated. For reasons explained below, the motor 24 has an upwardly directed vertical outlet shaft and the transmission system comprises in succession at least one universal joint 26, advantageously two universal joints 26, and an angle take-off system 27 connected to the drive shaft 25.

In the present invention, sealing means are also provided between the cylindrical body 22 and the drive shaft 25, in particular where the drive shaft 25 passes through the wall of the cylindrical body.

Figure 4:
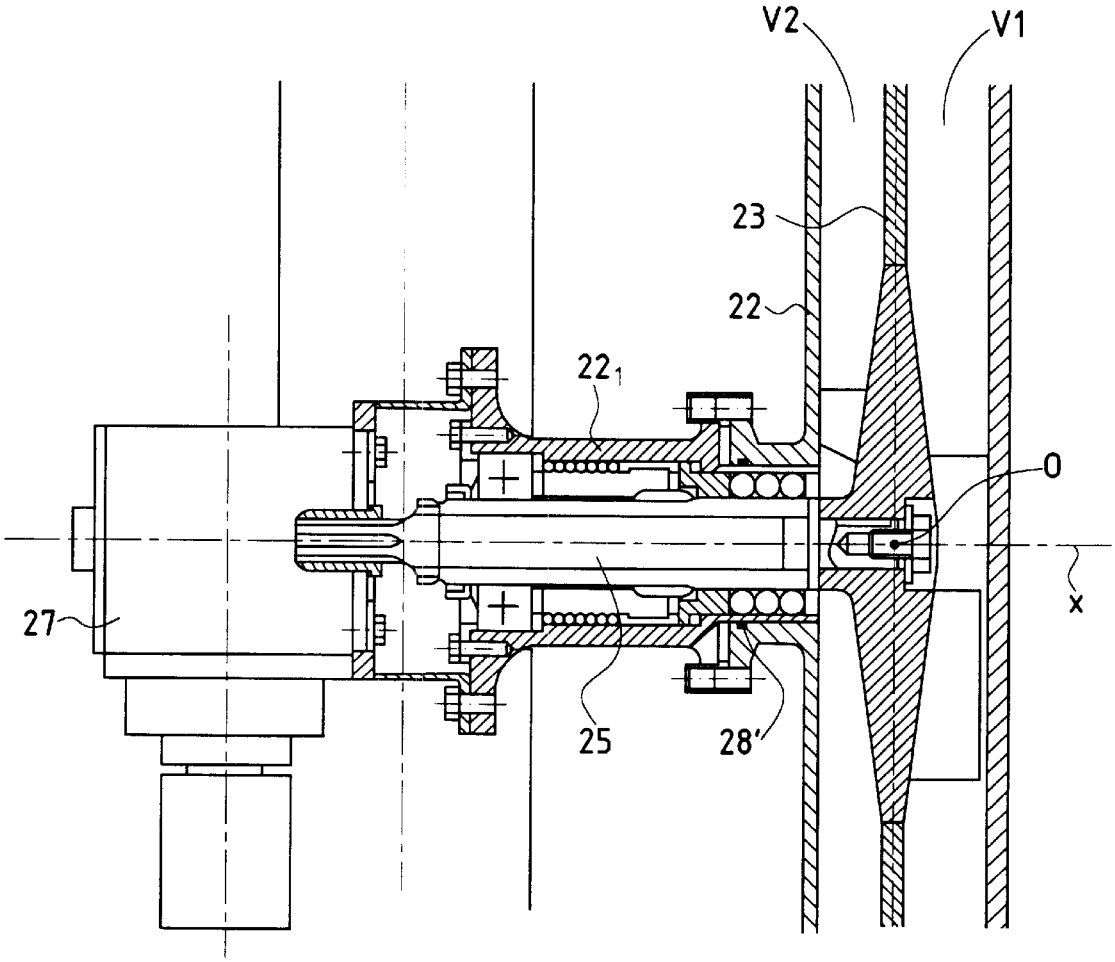
FIG. 4 is a view on a larger scale of zone IV in FIG. 1.

It is also necessary to provide sealing means between the inside of the cylindrical body 22 and its surroundings, e.g. by means of static annular gaskets 28 and 28', as can be seen in FIGS. 1 and 4.

As shown in FIG. 4, the cylindrical body 22 is open on its rotary axis Ox on the transmission-shaft side in order to make it possible to link the drive shaft 25 to the bladed disk. A cylindrical sleeve $\mathbf{22}_1$ serves to house the drive shaft 25 and also serves to extend the rear wall in the form of an open disk of the cylindrical body 22 (with an interposed sealing gasket 28') to the casing of the angle take-off 27.

Figure 2:
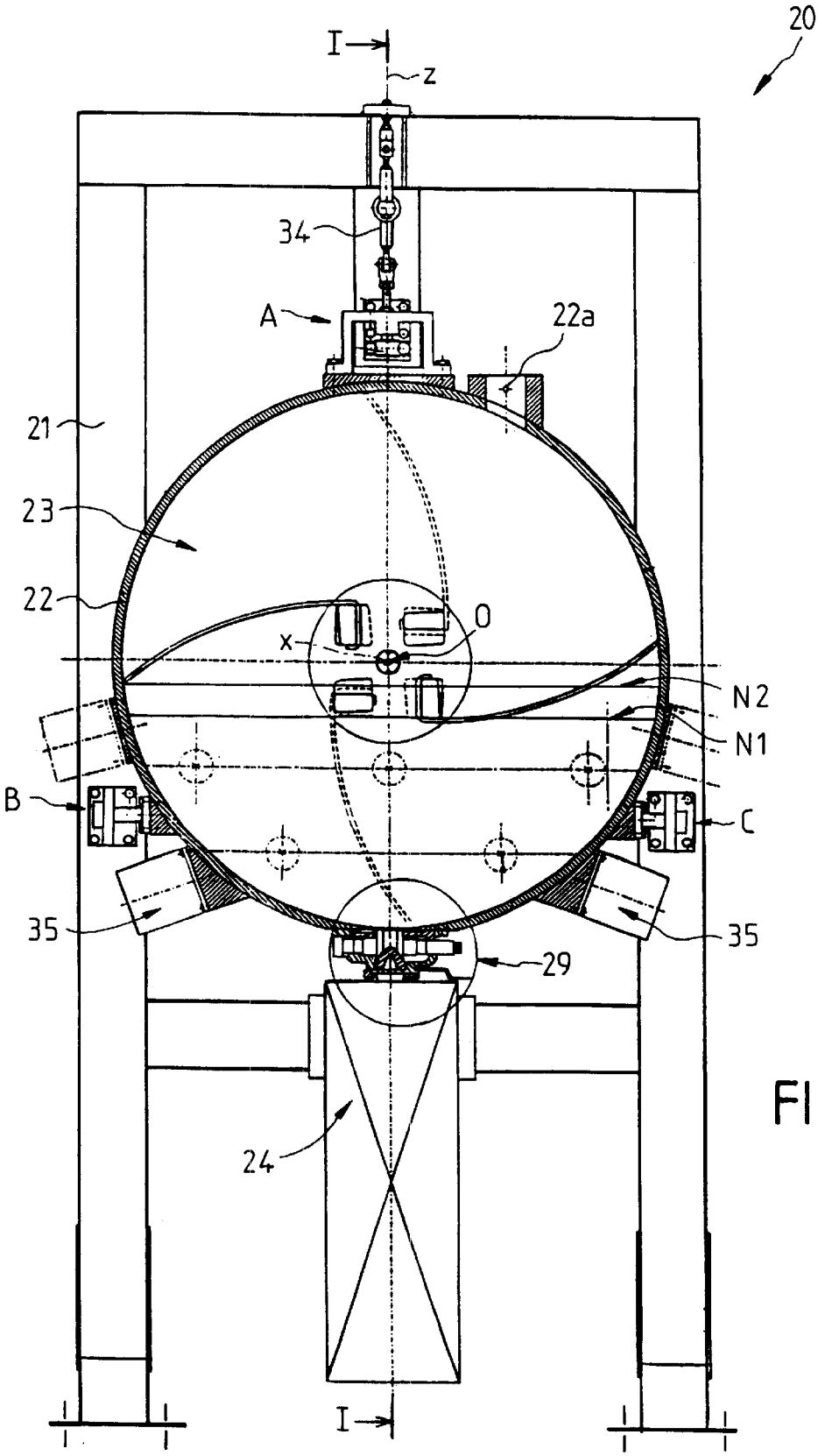
FIG. 2 is a cross-section view on direction II—II of FIG. 1.
Figure 3:
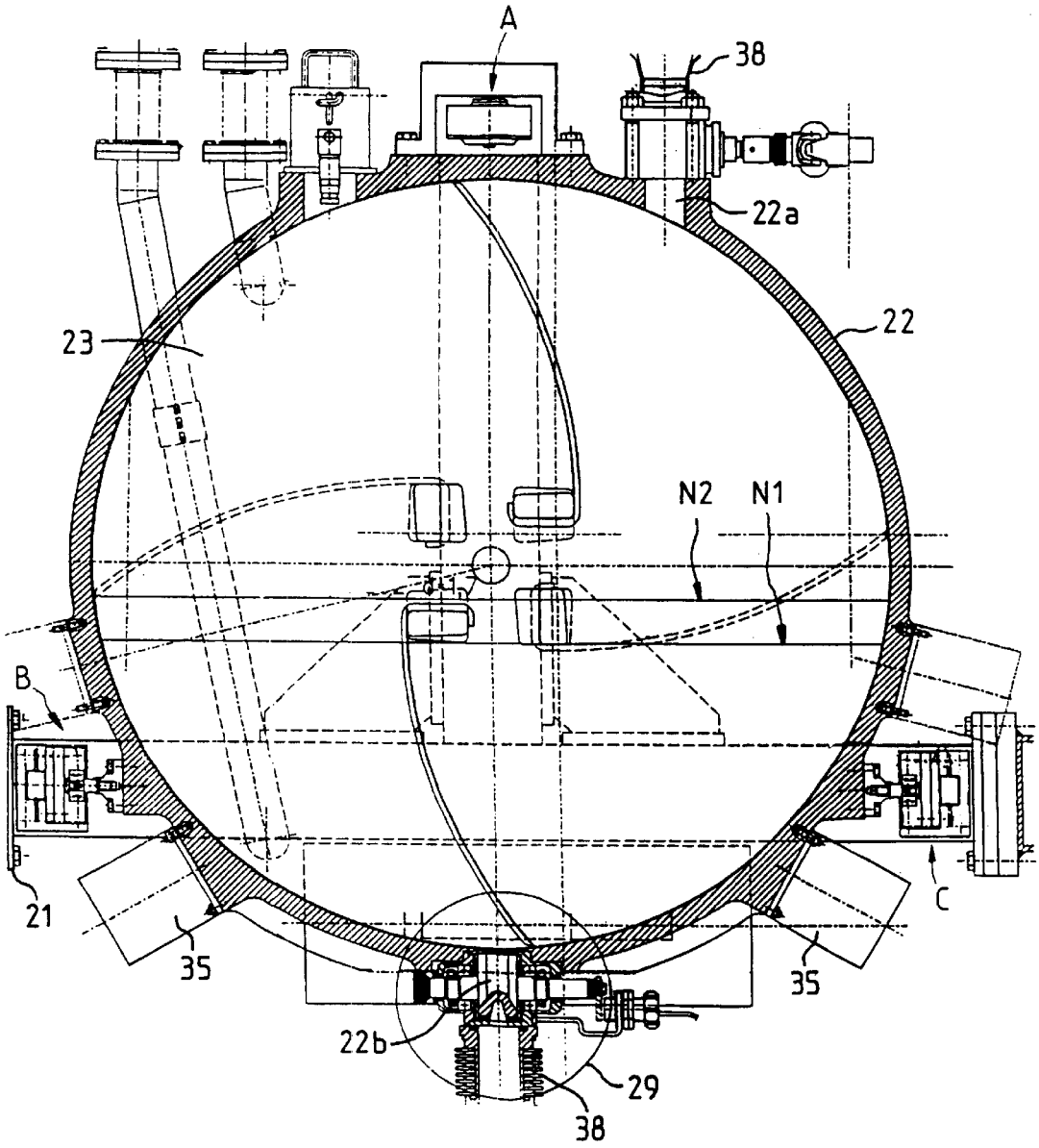
FIG. 3 is a partially transparent view on a larger scale of the powder mixing apparatus shown in FIG. 2 that comprises a cylindrical body suitable for being filled with powder.

In FIGS. 2 and 3, reference symbols N1 and N2 represent respectively the minimum level and the maximum level for filling the cylindrical body 22 that forms the mixing reservoir of the apparatus 20 of the present invention. Advantageously, these levels N1 and N2 lie beneath the center O of the circular section of the cylindrical body because powder is transferred from one compartment to another above this center, as explained below.

As explained above, the vertical bladed disk 23 subdivides the inside volume of the cylindrical body 22 into two cylindrical compartments V1 and V2 of equal capacity.

According to another essential characteristic of the present invention, when used with radioactive powder, the configuration of the cylindrical body 22 is "subcritical" corresponding to the cylindrical body having a maximum thickness that is allowable given the safety and criticality constraints which, together with the maximum volume of the fill to be mixed (volume less than half the volume of the cylindrical body 22), gives rise to the cylindrical body 22 having a large diameter. The cylindrical body thus presents "flat" symmetry.

A filling orifice 22*a* enables powder to be introduced into the cylindrical body 22 via its top portion, while an emptying orifice 22*b* opening out into the bottom of the cylindrical body 22 co-operates with an emptying valve 29 to enable the powder to be removed after it has been homogenized.

The diameter of the bladed disk 23 is equal to the inside diameter of the cylindrical body 22 so as to obtain practically leakproof contact that isolates the front and back compartments V1 and V2 respectively. Some clearance does indeed exist between the bladed disk and the cylindrical body in order to allow them to move relative to each other, so the clearance does not completely prevent powder from leaking, however the amount of powder that does leak remains small enough to avoid interfering with mixing.

Reference is made below to FIGS. 5 to 9 while describing the structure of the bladed disk 23 constituting the internal moving member of the cylindrical body 22 that forms the powder reservoir.

On each of its front and back faces $\mathbf{23}_1$ and $\mathbf{23}_2$ respectively, the bladed disk 23 has two blades 30 placed symmetrically to each other about the center O, with the four blades 30 being regularly offset at 90° intervals.

In cross-section (FIG. 5) each blade 30 is in the shape of a comma or an eyelash, extending essentially radially from the peripheral edge of the disk 23 where it has practically leakproof contact with the annular wall of the cylindrical body, towards the axis of rotation (Ox) as far as a circular central zone 23*a* of the disk 23 of radius that is preferably less than or equal to one-fourth of the radius of the disk 23.

Each blade 30 is essentially L-shaped, comprising a rod that constitutes the substantially radial segment 30*a*, which segment is curved, and a radially inner end segment 30*b* which forms the base of the L-shape.

Figure 5:
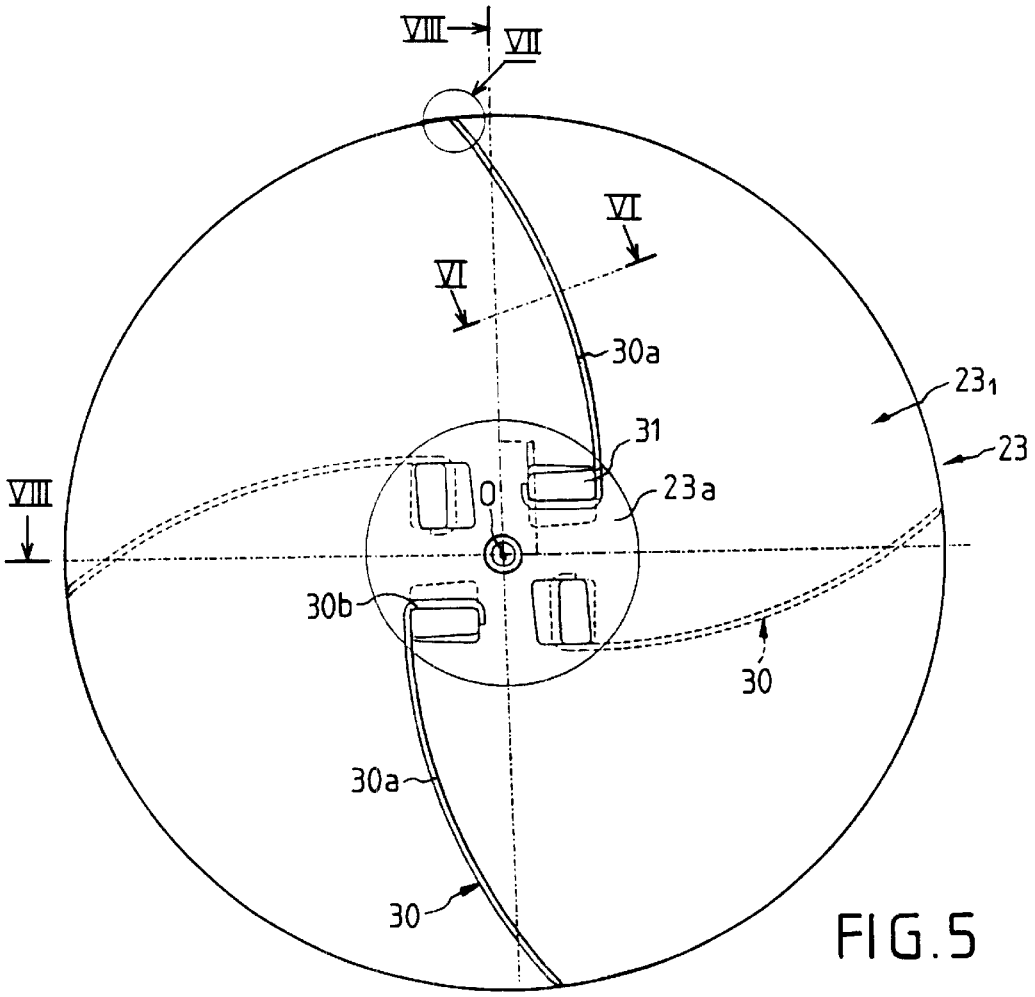
FIG. 5 is a partially transparent diagrammatic view of the cylindrical body in projection from its front face.
Figure 6:
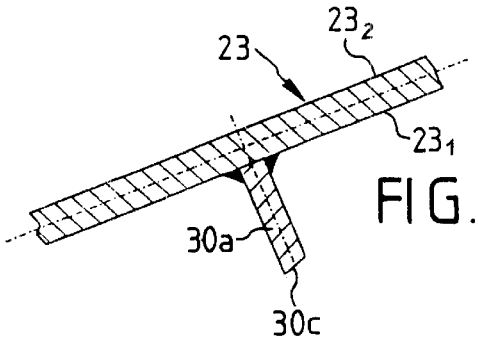
FIG. 6 is a fragmentary section view on direction VI—VI of FIG. 5 showing the connection zone between the disk and one of the blades.
Figure 7:
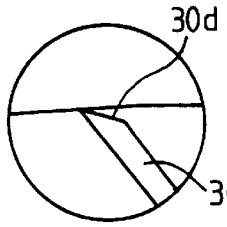
FIG. 7 is a view on a larger scale of a detail VII of FIG. 5.
Figure 8:
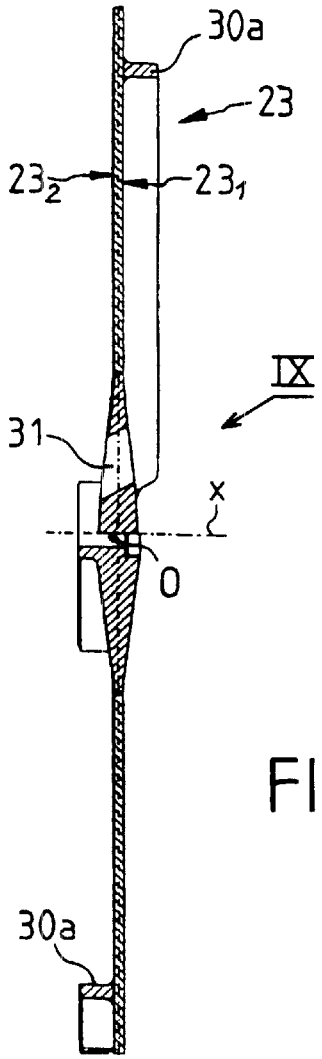
FIG. 8 is a cross-section view on line VIII—VIII of FIG. 5.
Figure 9:
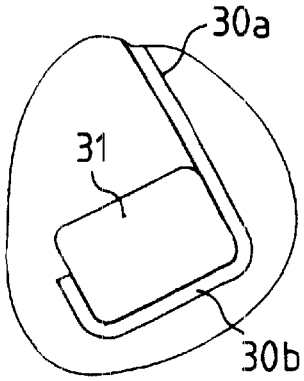
FIG. 9 is a fragmentary view on a larger scale and in projection of a transfer orifice as seen along direction IX in FIG. 8.

Each blade 30 is associated with a transfer orifice 31 passing through the central zone 23*a* of the disk 23 and of cross-section that is substantially rectangular. According to a particularly advantageous characteristic of the present invention, the radially inner end segment 30*b* of each blade extends along a portion of the edge of said corresponding transfer orifice 31. As shown in FIG. 5, the radially inner end segment 30*b* of each blade is preferably U-shaped, extending along a portion of the edge of said corresponding transfer orifice 31 belonging to three of the four sides of the section of said orifice. Thus, when a blade 30 is rotated out from the mass of powder, it entrains a unit volume of powder which will escape completely into the other compartment. This is made possible because, when the blade 30 is in its high position, the corresponding transfer orifice 31 lies above the center O of the disk 23, with the maximum level of powder being below O, and the radially inner end segment 30*b* forms a pierced bowl delivering to the other side of the disk all of said unit volume of powder that has slid along the substantially radial segment 30*a* as said blade 30 rises.

In this way, during rotation of the disk 23, the blades 30 entrain the powder which slides under gravity along each substantially radial segment 30*a* towards the corresponding transfer orifice 31, thereby enabling a portion of the powder to be transferred from one compartment to the other.

The above-described guidance of the powder is made possible by the blades 30 having respective side edges 30*c* (FIG. 6) and respective radially outer end edges 30*d* (FIG. 7) that are chamfered in shape so as to provide practically leakproof contact with the walls of the cylindrical body 22, respectively with the corresponding disk-shaped wall and with the annular wall.

Naturally, some other number of blades 30 could be provided on each face $\mathbf{23}_1$ and $\mathbf{23}_2$ of the bladed disk 23, providing there is at least one blade 30 on each of its two faces.

The mass of powder transferred from one compartment to the other on each half-revolution of the disk 23 depends on the number and the section of the transfer orifices 31. If the transferred mass is equivalent to $1/8^{th}$ of the total mass after one-half revolution of the disk, then the number of interfaces created in the medium is 8. After one complete revolution (2 cycles), this number is $8^2$. In this way, the number of interfaces that is established between the two initial fills loaded respectively into each of the two compartments V1 and V2 increases exponentially: mixing is thus performed by "quartering" which makes it possible to achieve a very high number of interfaces quickly, i.e. the powder is thoroughly mixed so as to obtain a composition that is uniform in terms of grain size and isotope content while preventing segregation from occurring.

As mentioned above, the powder mixing apparatus of the present invention is also specially adapted to make it possible to measure the mass of the powder-filled cylindrical body 22 on a continuous basis, and in particular while the body is being filled with powder.

This makes it easy to determine the instant at which it is necessary to stop feeding it with powder via the filling orifice 22*a* because the powder has reached the nominal level N1.

Figure 10:
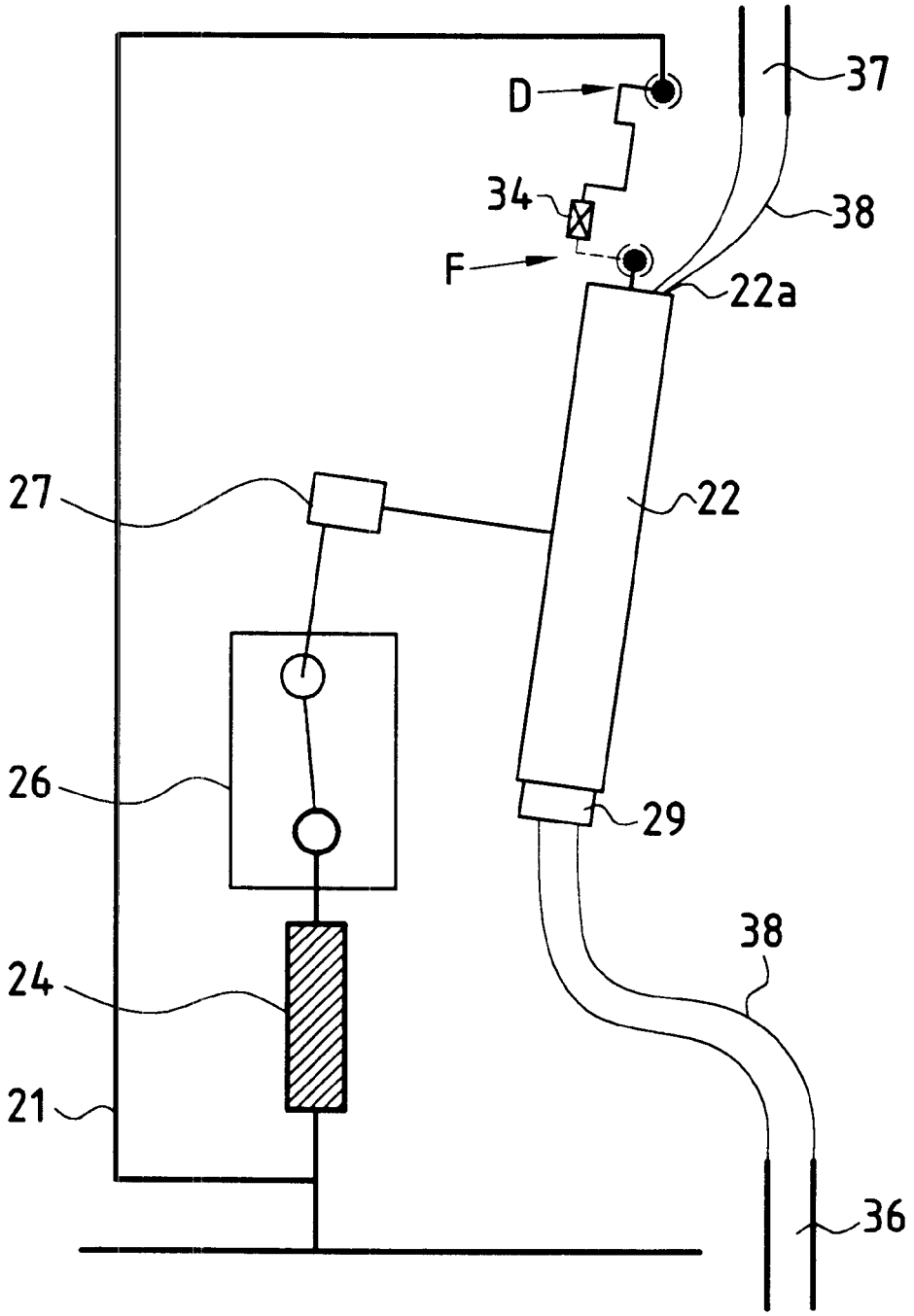
FIG. 10 is a diagrammatic side view of the dynamic linkage between the cylindrical body and the frame of the powder mixing apparatus.
Figure 11:
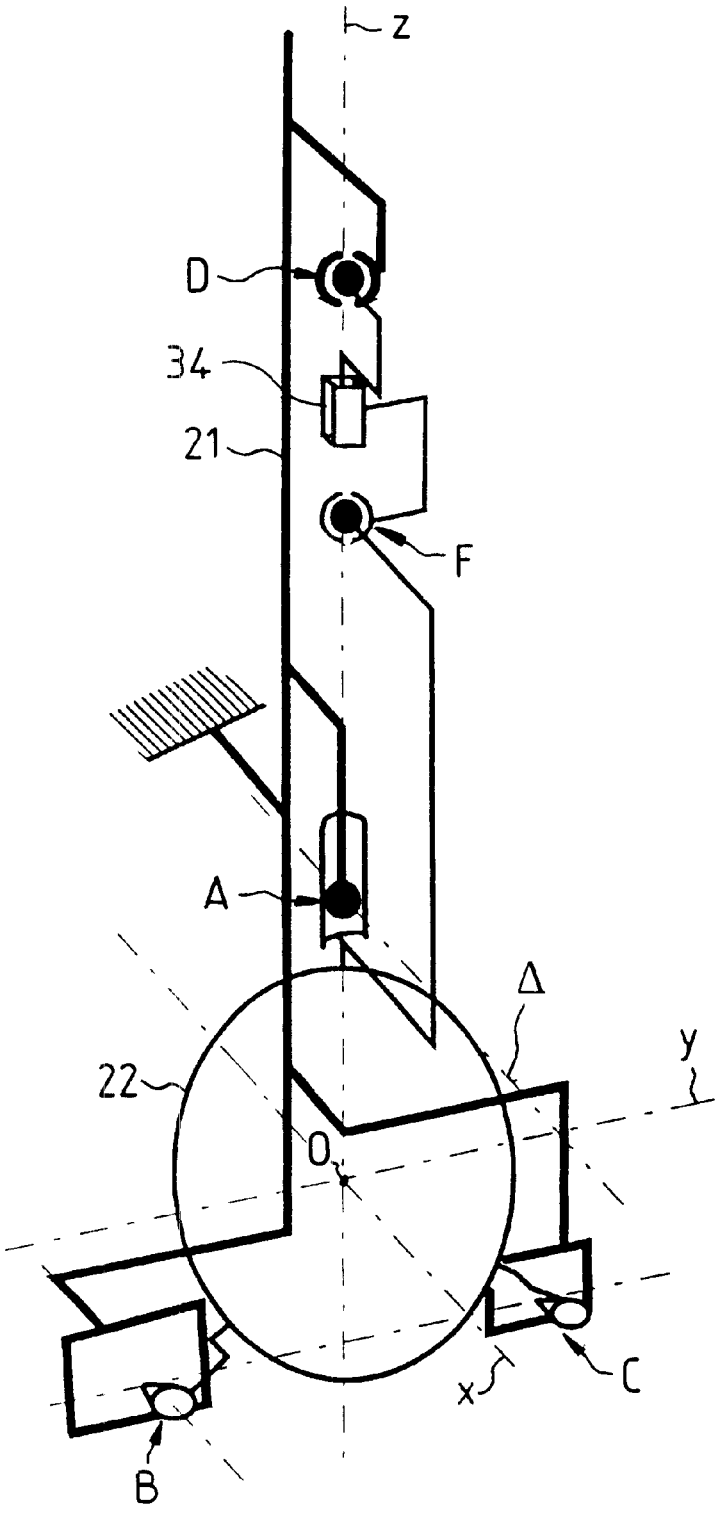
FIG. 11 is a diagrammatic perspective view showing the mechanical links between the cylindrical body and the frame of the powder mixing apparatus.

To this end, the powder mixing apparatus 20 includes a suspension weighing system mounted on the frame 21 and from which the cylindrical body 22 is suspended (see FIGS. 10 and 11). Advantageously, the suspension weighing system is of the type having a load cell 34, and it includes a deformable element in the form of a piezoelectric element. This load cell is located substantially in vertical alignment with the center O of the disk 23, above the cylindrical body 22.

It will thus be understood that any variation in the mass of the cylindrical body 22 while it is being filled will give rise to lengthening whose amplitude (about 0.5 mm) serves to determine the mass of powder contained in the cylindrical body 22.

Because the cylindrical body 22 moves in vertical translation while it is being filled, it is necessary for the transmission system between the outlet shaft of the motor 24 and the drive shaft 25, i.e. for the two universal joints 26 and the angle take-off 27, to follow the up and down movements of the cylindrical body 22 without impeding them so as to avoid disturbing measurement of the mass of the cylindrical body.

Since the assembly comprising the angle take-off 27, the drive shaft 25, and the bladed disk 23 is not deformable, and since it is secured to the cylindrical body 22, it is the degrees of freedom provided by the two universal joints 26 that allow said assembly to track the movements of the cylindrical body 22. The universal joints 26 serve to compensate for variations of alignment between the outlet shaft of the motor 24 and the inlet shaft of the angle take-off 27 which is associated with driving the mobile cylindrical body 22.

In this way, the powder mixing apparatus 20 has a transmission system extending from the motor means which are secured to the frame 21 and going to the drive shaft 25, where said transmission system is suitable for tracking the movement of the cylindrical body while it is being filled, and/or being emptied, and/or having its disk rotated.

The dynamic linkage between the load cell 34 and firstly the cylindrical body 22 and secondly the frame 21 is shown diagrammatically in FIG. 10 which also shows the above-described transmission system.

After the cylindrical body 22 has been filled, or possibly while it is being filled, mixing is performed by the bladed disk 23 rotating. As a result, the cylindrical body 22 is subject not only to a limited amount of vertical translation movement in the downward direction, but also to rotation about the vertical axis Oz and to titling motion a horizontal axis Δ parallel to its axis of rotation Ox as described below. In order to ensure that this possible tilting motion does not disturb the mass measurement performed by the load cell 34, an additional hinge link is provided between the cylindrical body 22 and the frame 21 at the load cell 34: two ball-and-socket links D and F are provided between the load cell 34 and respectively the frame 21 and the top portion of the cylindrical body 22, substantially in vertical alignment with the vertical axis of symmetry Oz of the cylindrical body 22, as can be seen in FIGS. 10 and 11.

Because of the mobility of the cylindrical body 22, albeit mobility that is limited, provision is made for the powder mixing apparatus 20 further to comprise at least one vibrator 35 mounted on said cylindrical body 22 so as to facilitate emptying thereof, thereby minimizing the amount of powder retained on the inside walls of the cylindrical body 22, both in normal operation and in the event of the disk 23 accidentally being prevented from rotating. As shown in FIG. 2, two vibrators 35 are preferably mounted symmetrically on either side of the plane of symmetry (Ox, Oz) of the cylindrical body 22. In which case, as shown in FIG. 10, the link between the emptying valve 29 and the emptying duct 36, and the links between the filling orifice 22*a* and the filling duct 37 are provided by bellows 38.

When the powder mixing apparatus 20 of the present invention is used to homogenize a batch of radioactive powder, in particular of plutonium dioxide ($PuO_2$), which may be for use in preparing MOX fuel for nuclear power stations, the powder mixing apparatus 20 is naturally located in a glove box in order to isolate it from the surroundings. Nevertheless, that precaution is not sufficient to ensure that the required safety constraints are complied with when they relate to seismic risk, thus making it necessary in this type of application, at least, to provide a suitable mechanical system for limiting possible movement of the cylindrical body 22 relative to the frame 21 so as to prevent the cylindrical body 22 being thrown through the glove box in the event of an earthquake. Because of the need to weigh the cylindrical body 22, the degrees of freedom of the cylindrical body must be restricted by an additional link which provides guidance in vertical translation. This guidance in vertical translation is performed by an assembly for providing guidance in vertical translation that needs to minimize the disturbance it imparts to weighing due to the friction forces it produces.

Figure 12:
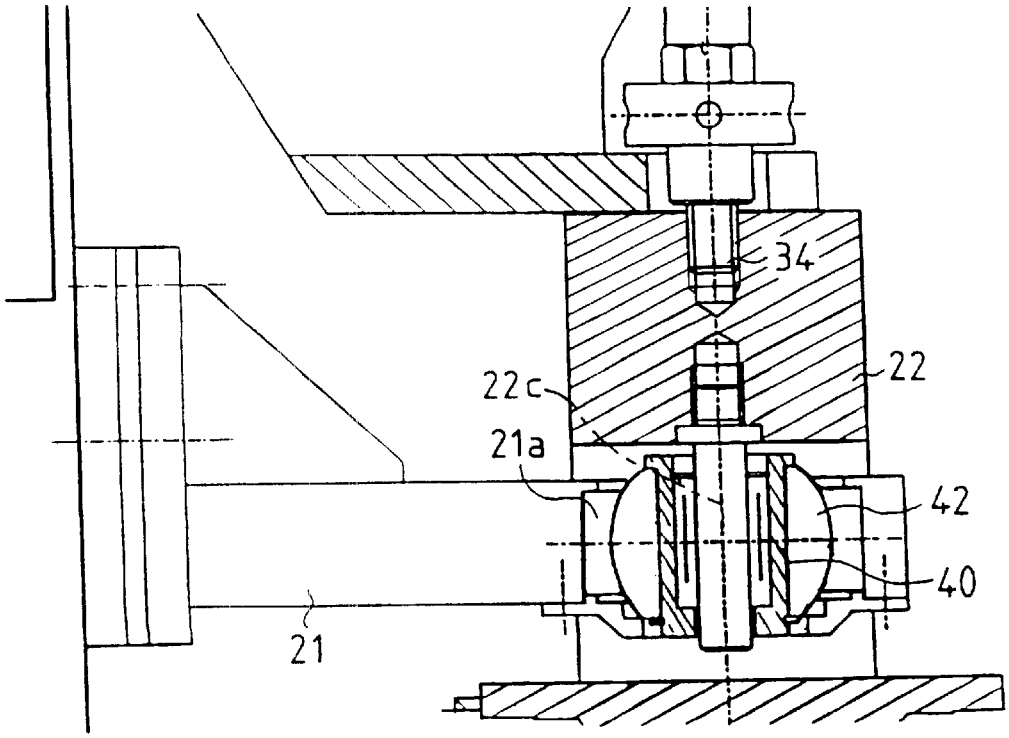
FIGS. 12 to 15 show the physical structure of some of the mechanical links represented in FIG. 11.
Figure 13:
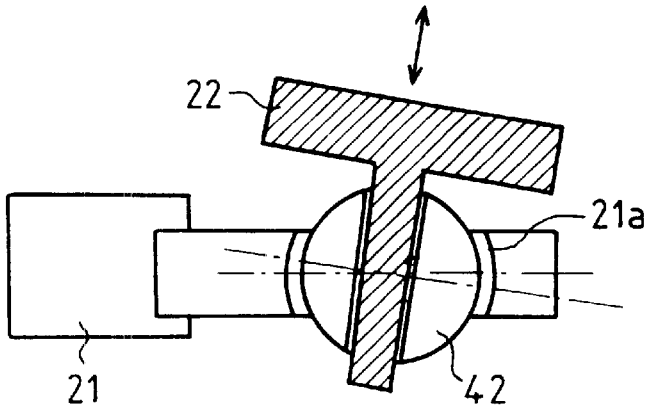

FIGS. 11 to 13 show the assembly for guiding the cylindrical body 22 in vertical translation relative to the frame 21, said guidance being provided by an association of links (A, B, and C) which restrain the degrees of freedom of the cylindrical body 22 relative to the frame 21 sufficiently to prevent the cylindrical body 22 being thrown against the walls of the glove box in the event of an earthquake, while nevertheless being of a design which minimizes the forces due to friction along any vertical component (i.e. parallel to the axis Oz).

This guide assembly comprises firstly an annular linear link A about the vertical axis Oz, between the cylindrical body 22 and the frame 21 (see FIG. 11), substantially in vertical alignment with the load cell 34 forming the weighing system.

FIGS. 12 and 13 show structural details of this annular linear link A: a vertical-axis circular-section cylinder 22*c* mounted on the cylindrical body 22 at one of its ends is received slidably, advantageously via a ball bushing 40, in a cylindrical bore of circular section in an inside sphere 42. In addition, a link piece 21*a* secured to the frame 21 and having an internal housing of spherical shape constitutes an "outer" sphere cooperating with said inner sphere 42 so as to form a ball-and-socket link.

Thus, the ball bushing 40 minimizes friction forces in the vertical direction between the cylinder 22*c* and the inner sphere 42 so that the cylinder 22*c* can move in translation along the vertical axis Oz located at a distance L from the frame 21, and it can also rotate about said vertical axis.

The horizontal tilt axis Δ about which the cylindrical body 22 is allowed to tilt passes through the center of the annular linear link A, as can be seen in FIG. 11.

Figure 14:
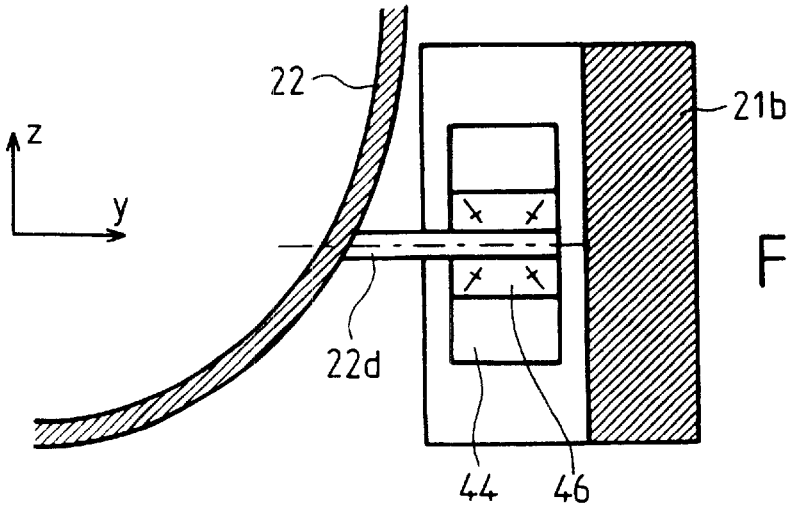
Figure 15:
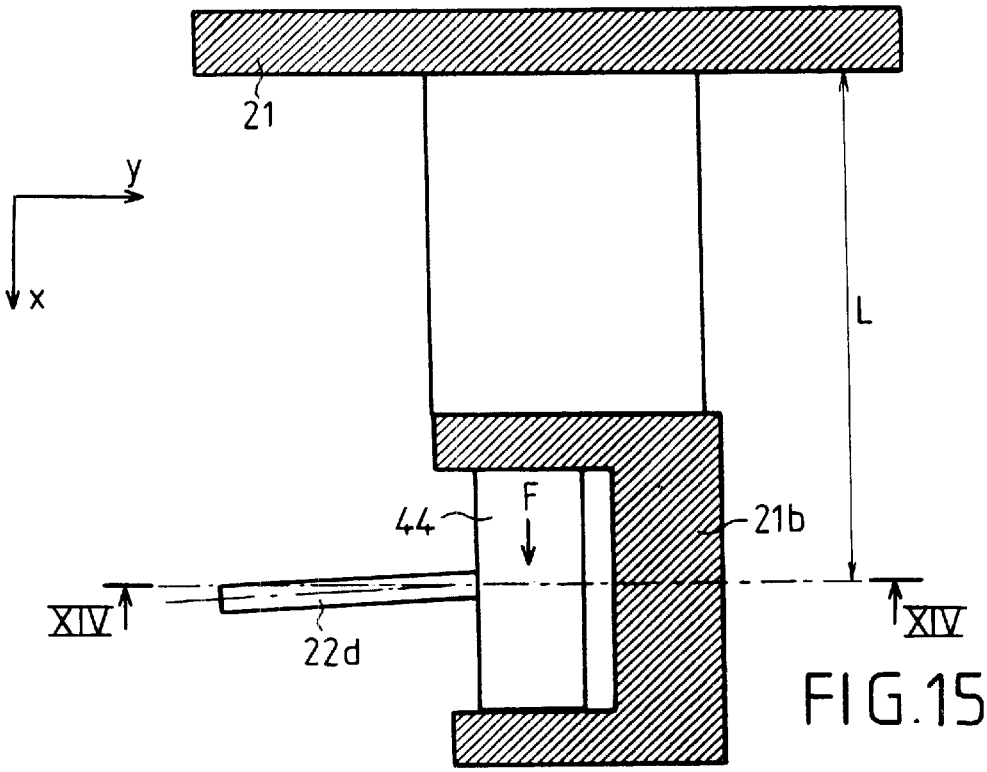

It will be understood that it is essential to restrict the angular displacement of the cylindrical body 22 about the axis Δ: this pivoting is limited by providing links B and C that can be seen in FIGS. 11 and 14 to 15. Each of these links B and C is considered as forming a point link whose normal axis is horizontal and longitudinal, parallel to Ox, and allowing movement in vertical translation between the bottom portion of the cylindrical body 22 and the frame 21.

To this end, the point links B and C are both implemented as follows: a vertical guide rail 21*b* secured to the frame 21 has a horizontal channel section comprising a web and two parallel flanges forming a vertical rolling track, extending orthogonally to the horizontal longitudinal axis Ox of the cylindrical body 22.

These point links B and C also comprise respective circular section cylindrical wheels 44 of diameter substantially equal to the width of the rail 21*b* such that the peripheral surface thereof forms an annular rolling surface of axis that is substantially horizontal and parallel to the transverse direction Oy, and suitable for rolling along the above-mentioned rolling part. The cylindrical wheel 44 is advantageously connected to the cylindrical body 22 by a shaft 22*d* having a first end secured to said cylindrical body 22 and a second end forming a ball-and-socket link by means of a ball 46 visible in FIG. 14 and associated with the cylindrical wheel 44. In this way, the ball 46 allows the wheel 44 to roll in a vertical direction without sliding on the running track of the rail 21*b,* even if the shaft 22*d* is not perpendicular to the web of the rail 21*b,* thereby reducing vertical forces due to friction.

In addition, the point links B and C prevent the cylindrical body 22 from pivoting about the vertical axis Oz, which pivoting could be generated under the dynamic effect of the moving mass of powder while mixing is taking place tending to pivot the cylindrical body 22 about the axis Δ, because of the reaction force F (FIG. 15) exerted by the running track on the wheel 44.

Because of rotation about the axis Oz and because of the cylindrical body 22 tilting about the axis Δ, the wheel 44 in each of the two point links B and C can be caused to move in translation by sliding laterally in the transverse horizontal direction Oy. This limited translation is made possible by an assembly clearance of a few millimeters between the web of the rail 21*b* and the rear edge of the side wall of the wheel 44 constituting the annular rolling surface.

It should be observed that because the above-mentioned clearance is relatively small, the links B and C are considered as being point links and not as annular linear links.

In operation, pivoting of the cylindrical body 22 about the axis Δ is assumed to be small in amplitude such that the wheels 44 never come into abutment against the web of the rail 21*b* in either of the links B and C. In addition, this sliding of the wheel 44 gives rise to a transverse force which opposes movement of the cylindrical body 22 along the direction Oy, without disturbing weight measurement since this friction does not act along the vertical axis Oz.

Thus, guidance is obtained for the cylindrical body 22 in vertical translation that prevents it from being thrown against the wall of the glove box in the event of an earthquake, since in normal operation such guidance in vertical translation allows the cylindrical body 22 only two degrees of freedom relative to the frame 21, i.e. translation along the axis Oz and pivoting about the axis A parallel to the axis Ox.

In the event of an earthquake, these two degrees of freedom are restricted:

translation along the axis Oz is limited firstly by the load cell 34. Thereafter, even if the load cell breaks, the design of the annular linear link A is such that the cylinder 22*c* would slide under the effect of gravity in the inner sphere 42 until the cylindrical body 22 came into abutment against said inner sphere 42, which is itself prevented from moving in translation relative to the frame 21, such that further downward vertical translation of the cylindrical body 22 would then be prevented; and pivoting of the cylindrical body 22 about the axis Δ (pivoting about an axis parallel to the axis Ox) is limited by the way in which the almost point links B and C are made. If the cylindrical body 22 should tilt through an abnormally large angle about the axis Δ, then the wheel 44 of the link B or C would come into abutment against the web of the associated rail 21*b*.

It should be observed that in order to keep forces via the links B and C in the plane (Ox, Oy) to a constant minimum level, it is necessary to balance the assembly comprising the transmission system and the cylindrical body 22 in such a manner that its center of gravity G is always situated in the plane (Oy, Oz) even when the level to which the cylindrical body 22 is filled varies.

In particularly advantageous manner, at least two powder mixing apparatuses 20 as described above can be used for implementing a method of cooling a powder on leaving a furnace, such as a calciner used in the last step of reprocessing nuclear fuel, and for making up the powder into batches, the method comprising the following steps:

a) said motor means 24 of each powder mixing apparatus 20 are controlled to rotate the disk 23 of each powder mixing apparatus;

b) said outlet of the furnace is connected to the filling orifice 22*a* of the cylindrical body 22 of a first powder mixing apparatus;

c) powder is filled into the cylindrical body 22 of the first powder mixing apparatus in controlled manner, advantageously while said disk is rotating;

d) the outlet of said furnace is transferred to the filling orifice 22*a* of the body of a second powder mixing apparatus before the cylindrical body 22 of said first powder mixing apparatus has been half-filled; and e) said body of said first powder mixing apparatus is emptied into at least one receptacle while the cylindrical body 22 of said second powder mixing apparatus is being filled in controlled manner, with the method returning to step c) for the second powder mixing apparatus.

In a preferred characteristic of the present invention, the controlled filling of each cylindrical body 22 is performed by measuring the weight of said cylindrical body 22 while it is being filled by means of said suspension weighing system, while rotation of said disk 23 continuously mixes said powder.

In this way, a changeover is achieved from a continuous flow of powder ($PuO_2$ at the outlet from the calciner) to a discontinuous flow (alternate emptying of the cylindrical bodies 22 of one of two (or more) powder mixing apparatuses, at the outlet of which batches of powder are obtained having characteristics that are very similar).

What is claimed is:

1. Powder mixing apparatus, comprising:

a cylindrical body of circular section and of substantially horizontal longitudinal axis, which body is leakproof and has two substantially parallel disk-shaped walls and one uninterrupted annular wall intersecting both said disk shaped walls at an inside diameter, said body being provided with at least one filling orifice situated at a top of said body disposed above the longitudinal axis and with at least one emptying orifice opening out into the bottom of said body disposed below the longitudinal axis;

a disk having an outside diameter substantially equal to the inside diameter of the annular wall and being placed coaxially inside said body, the edge of said disk being substantially in contact with the annular wall so as to subdivide said body into two cylindrical compartments of substantially equal volume, said disk being provided on each of its faces with at least one blade that is substantially in contact at least with the disk-shaped wall adjacent to said blade, said blade serving to guide said powder during rotation of said disk to a radially inner end segment of said blade adjacent to a corresponding transfer orifice passing through said disk so as to enable at least a portion of the powder to pass from one compartment to the other on each revolution of the disk, said blades being angularly offset;

a horizontal drive shaft secured to the center of said disk to rotate said disk; and motor means for rotating said drive shaft.

2. Apparatus according to claim 1, wherein said blades are substantially L-shaped, said radially inner end segment forming the base of the L-shape and extending along a portion of the edge of said corresponding transfer orifice.

3. Apparatus according to claim 2, wherein each of said blades has a substantially radial segment which constitutes the upright of the L-shape and which is curved.

4. Apparatus according to claim 2, wherein said transfer orifices are substantially rectangular in section, said radially inner end portions of the blades being U-shaped, extending along a portion of the edge of said corresponding transfer orifice belonging to three of the sides of the section of said orifice.

5. Apparatus according to claim 1, wherein, on each of its faces, said disk carries two blades which are placed symmetrically relative to each other, the four blades being angularly offset regularly at 90° intervals.

6. Apparatus according to claim 1, wherein each blade extends substantially radially from the edge of said disk where it is substantially in contact with said annular wall of the cylindrical body, to a central zone of the disk of radius that is less than or equal to one-fourth the radius of said disk.

7. Apparatus according to claim 1, further comprising sealing means between said cylindrical body and said drive shaft.

8. Apparatus according to claim 1, further comprising a rigid frame and a suspension weighing system for weighing said cylindrical body, the weighing system comprising a deformable element connected to said frame and having said cylindrical body suspended therefrom, variation in the length of said deformable element representing variation in the weight of said cylindrical body.

9. Apparatus according to claim 8, further comprising a transmission system extending from said motor means which are secured to said frame to said drive shaft, said transmission system being suitable for tracking the movement of the cylindrical body while it is being filled, and/or emptied, and/or while the disk is rotating.

10. Apparatus according to claim 9, wherein said transmission system includes at least one universal joint.

11. Apparatus according to claim 10, wherein said motor means comprise a vertical outlet shaft, and wherein said transmission system further comprises an angle take-off system between said universal joint and said drive shaft.

12. Apparatus according to claim 8, her comprising respective ball-and-socket links between said frame and said deformable element and, also between said deformable element and said cylindrical body.

13. Apparatus according to claim 8, further comprising at least one vibrator mounted on said cylindrical body in order to facilitate emptying thereof.

14. Apparatus according to claim 8, wherein said deformable element is a piezoelectric element.

15. Apparatus according to claim 8, further comprising a guide assembly for guiding said cylindrical body in vertical translation and mounted on said frame.

16. Apparatus according to claim 15, wherein said guide assembly comprises an annular linear link having a vertical axis disposed between said cylindrical body and said frame, said annular linear link being substantially in alignment with said deformable element.

17. Apparatus according to claim 16, wherein said guide assembly further comprises at least one point link with an axis that is normally horizontal between the bottom portion of ad cylindrical body and said frame.

18. Apparatus according to claim 17, wherein said guide assembly has two point links disposed symmetrically on either side of the vertical plane of symmetry of the cylindrical body and containing its longitudinal horizontal axis.

19. Powder mixing apparatus, comprising:

a cylindrical body of circular section and of substantially horizontal longitudinal axis, which body is leakproof and has two disk-shaped walls and one annular wall, said body being provided with at least one filling orifice situated at the top of said body and with at least one emptying orifice opening out into the bottom of said body;

a disk placed coaxially inside said body, edge of said disk being substantially in contact with the annular wall so as to subdivide said body into two cylindrical compartments of substantially equal volume, said disk being provided on each of its faces with at least one blade that is substantially in contact at least with the disk-shaped wall adjacent to said blade, said blade serving to guide said powder during rotation of said disk to a radially inner end segment of said blade adjacent to a corresponding transfer orifice passing through said disk so as to enable at least a portion of the powder to pass from one compartment to the other on each revolution of the disk, said blades being angularly offset;

a horizontal drive shaft secured to the center of said disk to rotate said disk;

motor means for rotating said drive shaft; a rigid frame and a suspension weighing system for weighing said cylindrical body, the weighing system comprising a deformable element connected to said frame and having said cylindrical body suspended therefrom, variation in the length of said deformable element representing variation in the weight of said cylindrical body; and a guide assembly for guiding said cylindrical body in vertical translation and mounted on said frame;

wherein said glide assembly comprises an annular linear link having a vertical axis disposed between said cylindrical body and said frame, said annular linear link being substantially in alignment with said deformable element;

wherein said annular linear link comprises a cylinder having a substantially vertical axis, fixed at its top end to said cylindrical body, and slidably mounted in a cylindrical bore inside a sphere, and a link piece secured to said frame and presenting a spherical inner housing co-operating with said sphere to form a ball-and-socket joint.

20. Apparatus according to claim 19, wherein said annular linear link further comprises a ball bushing disposed between said cylinder and said sphere so as to minimize friction forces in the vertical direction.

21. Powder mixing apparatus, comprising:

a cylindrical body of circular section and of substantially horizontal longitudinal axis, which body is leakproof and has two disk-shaped walls and one annular wall, said body being provided with at least one filling orifice situated at the top of said body and with at least one emptying orifice opening out into the bottom of said body;

a disk placed coaxially inside said body, the edge of said disk being substantially in contact with the annular wall so as to subdivide said body into two cylindrical compartments of substantially equal volume, said disk being provided on each of its faces with at least one blade that is substantially in contact at least with the disk-shaped wall adjacent to said blade, said blade serving to guide said powder during rotation of said disk to a radially inner end segment of said blade adjacent to a corresponding transfer orifice passing through said disk so as to enable at least a portion of the powder to pass from one compartment to the other on each revolution of the disk, said blades being angularly offset;

a horizontal drive shaft secured to the center of said disk to rotate said disk;

motor means for rotating said drive shaft; a rigid frame and a suspension weighing system for weighing said cylindrical body, the weighing system comprising a deformable element connected to said frame and having said cylindrical body suspended therefrom, variation in the length of said deformable element representing variation in the weight of said cylindrical body; and a guide assembly for guiding said cylindrical body in vertical translation and mounted on said frame;

wherein said guide assembly comprises an annular linear link having a vertical axis disposed between said cylindrical body and said frame, said annular linear link being substantially in alignment with said deformable element;

wherein said guide assembly further comprises at least one point link with an axis that is normally horizontal between the bottom portion of said cylindrical body and said frame;

wherein said at least one point link comprises a vertical guide rail secured to said frame and of channel-section, having a web and two parallel flanges forming a vertical running track orthogonal to said horizontal longitudinal axis of said cylindrical body, and a cylindrical wheel of circular section whose diameter is substantially equal to the width of said rail such that its peripheral surface forms an annular running surface having an axis that is substantially horizontal and orthogonal to said horizontal longitudinal axis, and suitable for running on said running track, said cylindrical wheel being connected to said cylindrical body via a link shaft with a first end that is secured to said cylindrical body.

22. Apparatus according to claim 21, wherein a second end of said link shaft forms a ball-and-socket link with said cylindrical wheel.

23. Apparatus according to claim 21, wherein transverse clearance exists between the web of said guide rail and said cylindrical wheel so as to allow said cylindrical body to move a certain angular displacement about an additional horizontal longitudinal axis passing through the ball-and-socket joint of said annular linear link.

24. Powder mixing apparatus, comprising:

a cylindrical body of circular section and of substantially horizontal longitudinal axis, which body is leakproof and has two disk-shaped walls and one annular wall, said body being provided with at least one filling orifice situated at the top of said body and with at least one emptying orifice opening out into the bottom of said body;

a disk placed coaxially inside said body, the edge of said disk being substantially in contact with the annular wall so as to subdivide said body into two cylindrical compartments of substantially equal volume, said disk being provided on each of its faces with at least one blade that is substantially in contact at least with the disk-shaped wall adjacent to said blade, said blade serving to guide said powder during rotation of said disk to a radially inner end segment of said blade adjacent to a corresponding transfer orifice passing through said disk so as to enable at least a portion of the powder to pass from one compartment to the other on each revolution of the disk, said blades being angularly offset;

a horizontal drive shaft secured to the center of said disk to rotate said disk;

motor means for rotating said drive shaft;

a rigid frame and a suspension weighing system for weighing said cylindrical body, the weighing system comprising a deformable element connected to said frame and having said cylindrical body suspended therefrom, variation in the length of said deformable element representing variation in the weight of said cylindrical body; and a guide assembly for guiding said cylindrical body in vertical translation and mounted on said frame.

* * * * *